United States Patent [19]

Koppenhöfer et al.

[11] 4,121,417

[45] Oct. 24, 1978

[54] GAS TURBINE

[75] Inventors: Dietrich Koppenhöfer, Weinstadt-Beutelsbach; Leopold Olbrich, Stuttgart; Friedrich Wefing, Nürtingen-Neckarhausen; Lothar Scholz, Berglen; Horst Bärwaldt, Stuttgart; Walter Chudaska, Ostfildern, all of Germany

[73] Assignee: Daimler-Benz Aktiengesellschaft, Stuttgart, Germany

[21] Appl. No.: 765,700

[22] Filed: Feb. 4, 1977

[30] Foreign Application Priority Data

Feb. 6, 1976 [DE] Fed. Rep. of Germany ..... 2604606

[51] Int. Cl.[2] ..... F02C 7/10

[52] U.S. Cl. ..... 60/39.51 H; 165/8

[58] Field of Search ..... 60/39.51 R, 39.51 H; 165/8, 9

[56] References Cited

U.S. PATENT DOCUMENTS 3,650,317 3/1972 Barnard ..... 60/39.51 H 3,875,993 4/1975 Penny ..... 165/9

3,985,181 10/1976 Guillot ..... 60/39.51 H

*Primary Examiner*—Louis J. Casaregola

*Attorney, Agent, or Firm*—Craig & Antonelli

[57] ABSTRACT

A gas turbine with a turbine housing which includes at least one regenerative chamber for the accommodation of a regenerative heat-exchanger adapted to be set into rotation and closed against the outside by a housing cover whereby the housing separating surface is adapted to be brought into abutment with a corresponding cover separating surface of the cover, and in which at least one sliding seal adapted to be brought into sliding contact with the heat-exchanger is arranged in the chamber and is secured at one of two mutually elastic fastening members of a mounting means, whose other fastening member is anchored at a chamber wall of the turbine housing; the housing separating surface is thereby located in a plane at least approximately perpendicular to the axis of rotation, while the sliding seal with an unstressed mounting means is disposed recessed with respect to the housing separating surface in an assembly position.

19 Claims, 3 Drawing Figures

GAS TURBINE

Figure 1:
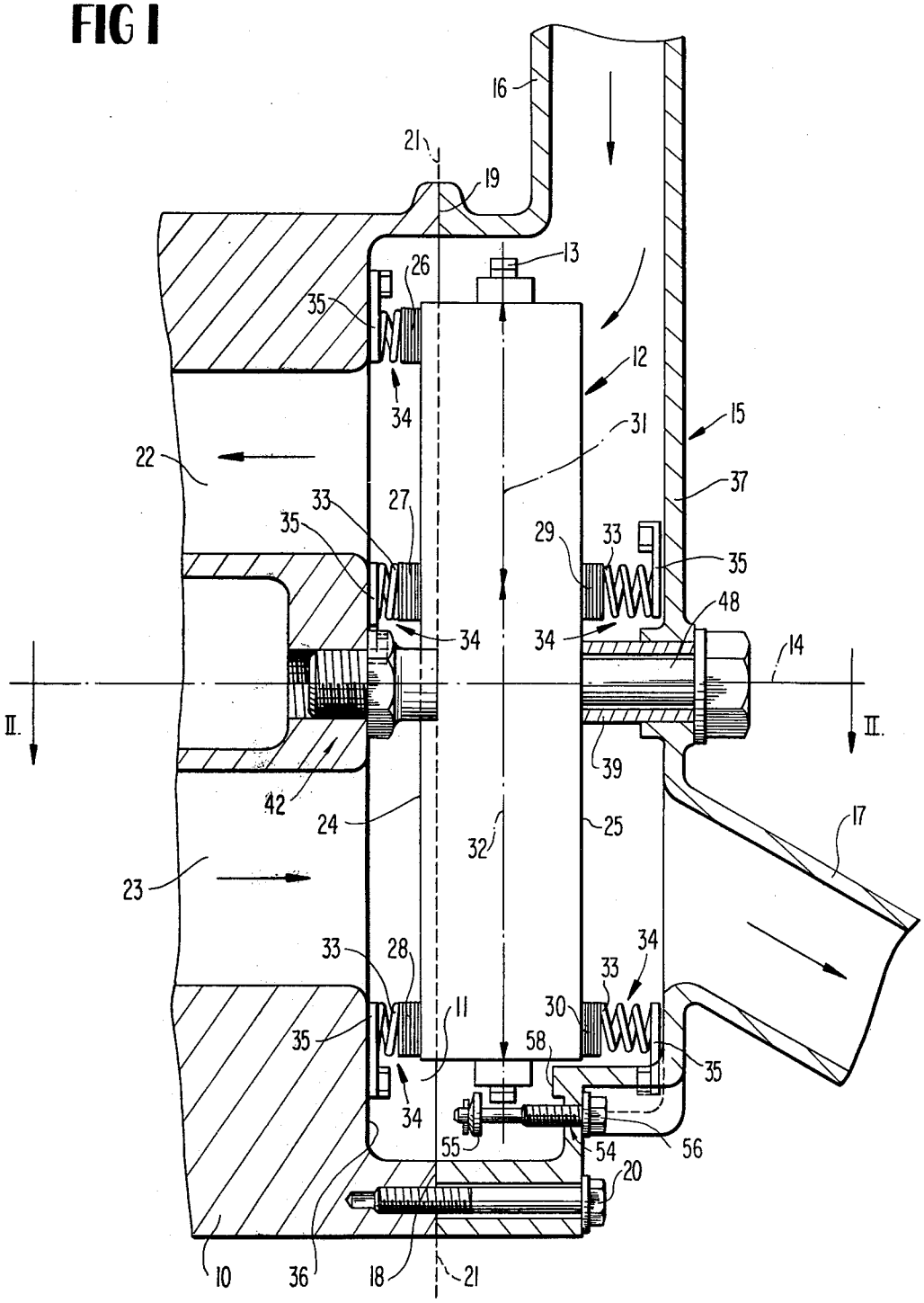

The present invention relates to a gas turbine with a turbine housing which includes at least one regenerative chamber closed against the outside by a housing cover for the accommodation of a regenerative heat-exchanger adapted to be set into rotation with respect to an axis of rotation fixed relative to the turbine housing and a housing separating surface adapted to be brought into mutual abutment with a corresponding cover-separating surface of the cover, and in which at least one slide seal adapted to be brought into sliding contact with the heat-exchanger is arranged in the chamber and is secured at one of two fastening parts of a mounting means which are elastic or springy relative to one another essentially in the directions of the axis of rotation, and whose other fastening part is anchored at a chamber wall of the turbine housing.

Gas turbines of this type are known in the prior art (German Offenlegungsschrift No. 2,407,443).

The task underlying the present invention essentially consists in enabling or facilitating in a gas turbine of the aforementioned type the installation of the heat-exchanger perpendicularly to the axis of rotation.

The underlying problems are solved in an advantageous manner according to the present invention in that the housing separating surface is located in a plane at least approximately perpendicular to the axis of rotation and the sliding seal, with an unstressed or relieved mounting means, is located in an assembly position recessed with respect to the housing separating surface.

In the gas turbine according to the present invention, the heat-exchanger together with the cover can be inserted into the turbine housing perpendicularly to the axis of rotation without being impaired thereby by the slide seals retained at the turbine housing.

For purposes of facilitating the removal of the heat-exchanger pependicularly to the axis of rotation, it is favorable in the gas turbine according to the present invention that the heat-exchanger is adapted to be anchored at the cover in an assembly position recessed with respect to the cover separating surface.

It is possible in this manner to assemble or disassemble the cover and heat-exchanger as a structural unit without thereby damaging the slide seals retained at the turbine housing or the heat-exchanger customarily consisting of a fragile ceramic material sensitive to breaking.

In gas turbines of the type with which the present invention is concerned, it is known that at least one slide seal adapted to be brought into sliding contact with the heat-exchanger is secured at one of two fastening parts of a mounting means which are springy relative to one another essentially in the directions of the axis of rotation, whereby the other fastening part is anchored at the cover.

In order to avoid that the sensitive heat-exchanger can be damaged during the assembly in that it hits or impinges hard at the cover by way of the slide seals under compression of the mounting means during the movement into its assembly position, provision is made in the gas turbine according to the present invention that in the assembly position of the heat-exchanger, the fastening member of the mounting means which is anchored at the cover, is elastically movable with respect to the other fastening member of the mounting means connected with the slide seal.

For purposes of anchoring the heat-exchanger in the assembly position thereof, provision is made in the gas turbine according to the present invention in that at least one tie rod accessible from the outside and cooperating with the heat-exchanger extends through the cover.

In order to prevent a canting of the heat-exchanger in the assembly position thereof and to assure that the mounting means of the seals secured at the cover are not completely compressed in the assembly position, it is advantageous in the gas turbine according to the present invention that the cover includes at least one abutment for the assembly position cooperating with a corresponding counter-abutment at a heat-exchanger.

The heat-exchanger can be brought by a simple axial displacement out of its operating position into the assembly position and vice versa in the gas turbine according to the present invention. This is made possible in that the heat-exchanger is supported on a hollow shift concentric to the axis of rotation, which is inserted immovable in the direction perpendicular to the axis of rotation into a bearing opening extending through the cover.

For purposes of relieving the cover from the bearing forces, it is additionally advantageous with the gas turbine according to the present invention that an anchor bolt extends through the hollow shaft and that the hollow shaft is clamped at a chamber wall of the turbine housing by means of the anchor bolt disposed with its bolt head outside the chamber.

If one uses the bolt head for clamping the hollow shaft at the turbine housing in addition to mounting the cover, then an accurate assembly or installation spacing has to be maintained between the bolt head and the turbine housing in order not to deform the cover by the bolt forces. This requires a machining of the corresponding abutment surfaces of the turbine housing and of the hollow shaft. For this purpose it is advantageous in the gas turbine according to the present invention that the anchor bolt is screwed into a threaded adaptor detachably secured at the chamber wall and the hollow shaft is clamped in between the threaded adaptor and the bolt head.

The machining of the turbine housing is still further simplified in the gas turbine according to the present invention in that the abutment surface of the threaded adaptor for the hollow shaft lies at least approximately in a plane with the housing separating surface.

Accordingly, it is an object of the present invention to provide a gas turbine which avoids by simple means the aforementioned shortcomings and drawbacks encountered in the prior art.

Another object of the present invention resides in a gas turbine which greatly simplifies the installation of the heat-exchanger perpendicularly to the axis of rotation thereof.

A further object of the present invention resides in a gas turbine whose heat-exchanger can be installed and removed in a simple manner without danger to fragile parts thereof.

A still further object of the present invention resides in a gas turbine of the type described above which minimizes damage to the ceramic material of the heat-exchanger which is normally sensitive to breaking, during the assembly and disassembly thereof.

Still another object of the present invention resides in a gas turbine which prevents the canting of the heat-exchanger in the assembly position thereof.

A further object of the present invention resides in a gas turbine of the type described above in which the heat-exchanger can be brought into the assembly position from its operating position and vice versa by a mere simple axial displacement.

A still further object of the present invention resides in a gas turbine in which the cover thereof is far-reachingly relieved of bearing forces while at the same time expensive accurate machining operations are far-reachingly minimized, especially insofar as the abutment surfaces are concerned.

Figure 2:
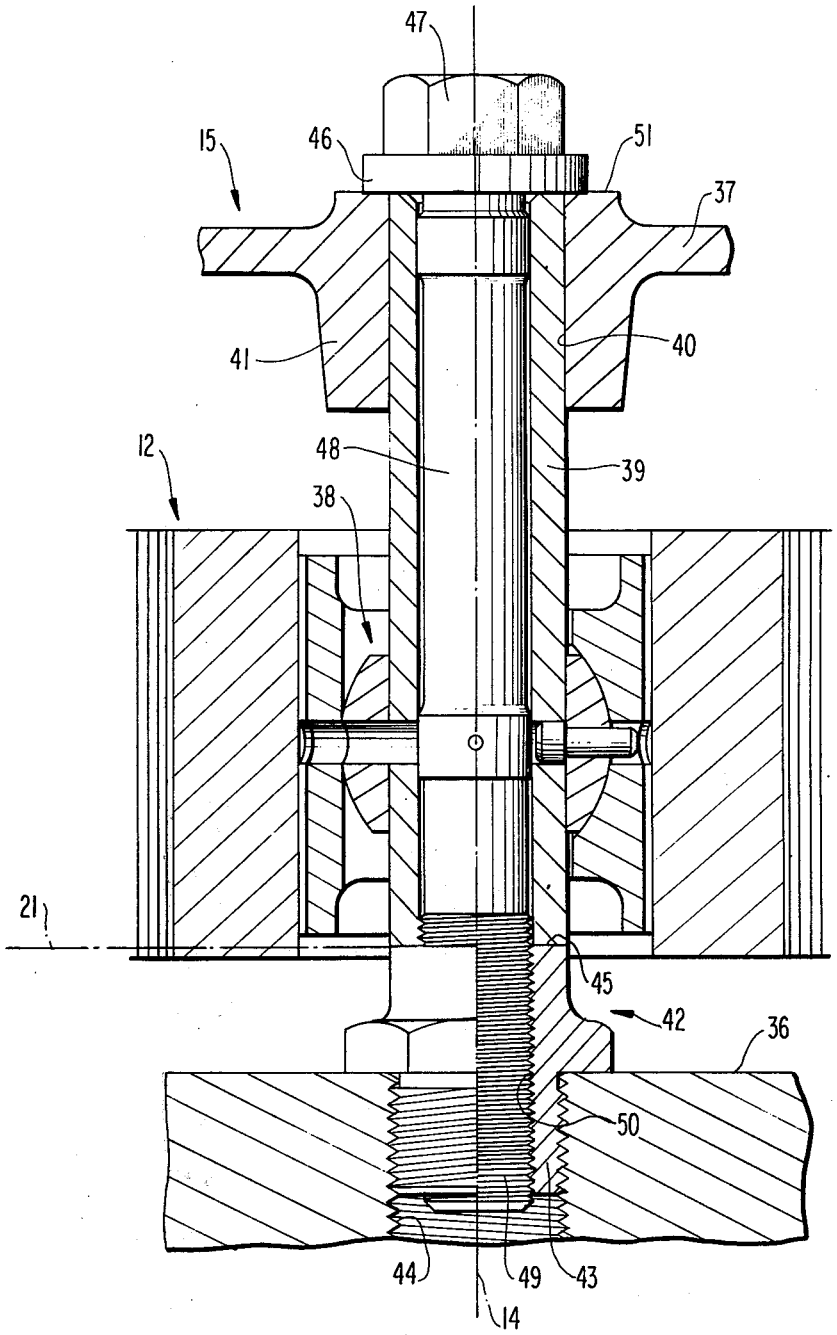
Figure 3:
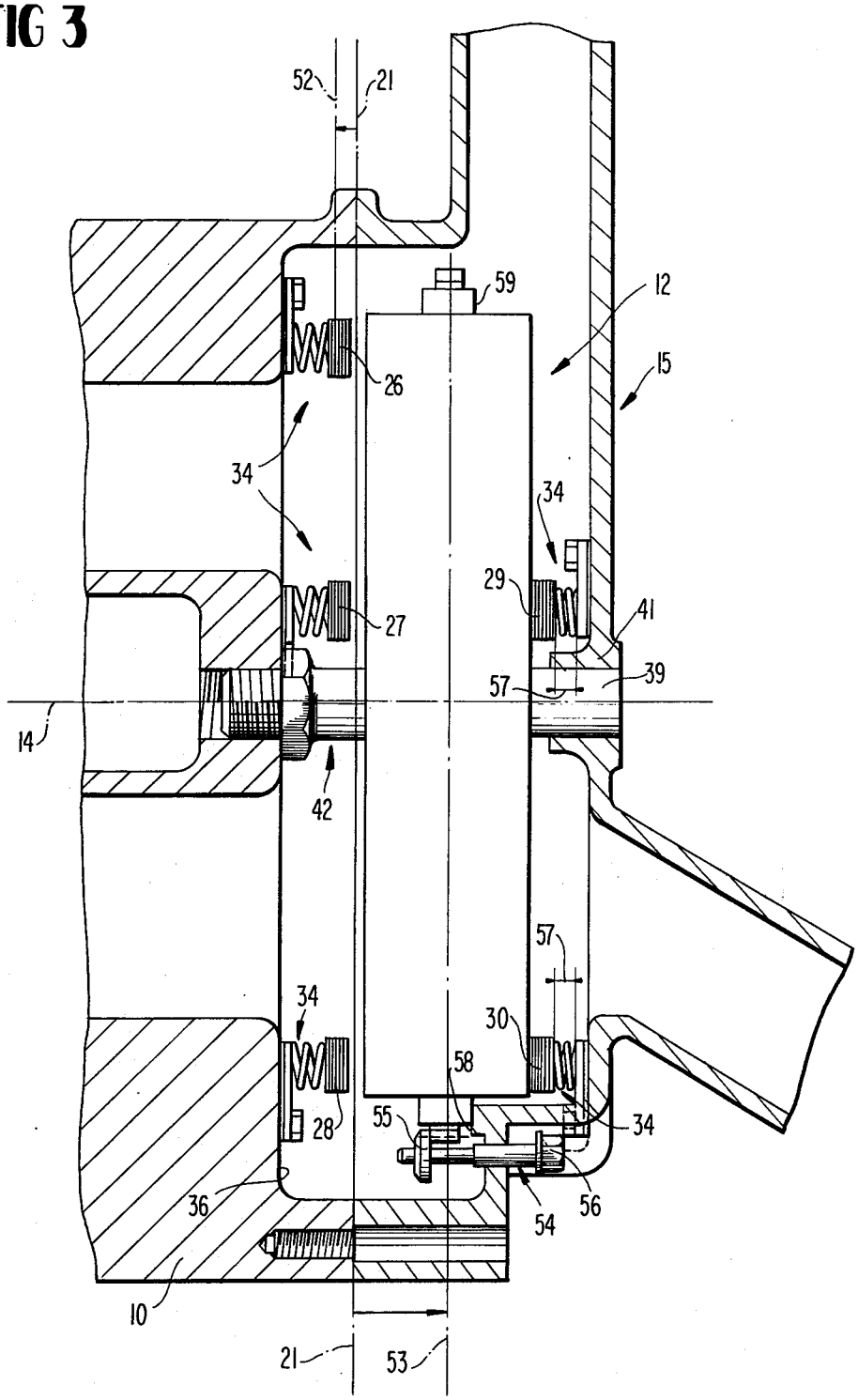

These and other objects, features and advantages of the present invention will become more apparent from the following description when taken in connection with the accompanying drawing which shows, for purposes of illustration only, one embodiment in accordance with the present invention, and wherein:

FIG. 1 is an axial cross-sectional view, on a reduced scale, through the lateral housing end of a gas turbine according to the present invention for driving a motor vehicle, in which a regenerative heat-exchanger is schematically shown in its operating position;

FIG. 2 is a cross-sectional view approximately to scale through the gas turbine in accordance with the present invention taken along line II—II of FIG. 1; and FIG. 3 is a cross-sectional view corresponding to FIG. 1 through the gas turbine according to the present invention in which the heat-exchanger is shown in its assembly position and the fastening means of the cover have been removed for the sake of clarity.

Referring now to the drawing wherein like reference numerals are used throughout the various views to designate like parts, the turbine housing 10 of the gas turbine, not illustrated in detail, includes a regenerative chamber 11 for a disk-shaped regenerative heat-exchanger generally designated by reference numeral 12 of a fragile ceramic material susceptible to breakage, which is adapted to be set into rotation with respect to an axis of rotation 14 fixed relative to the turbine housing 10 by means of a toothed rim 13 secured at its circumference. The chamber 11 is closed off against the outside by a housing cover generally designated by reference numeral 15 which includes an inlet pipe connection 16 for the compressed combustion air and an outlet pipe connection 17 for the exhaust gases and is also secured at the turbine housing by means of fastening bolts 20 retaining a cover separating surface 18 in gas-tight abutment at a housing separating surface 19. The separating surfaces 18 and 19 are disposed in a plane 21—21 perpendicular to the axis of rotation 14. One housing channel each 22 and 23 for heated combustion air and exhaust gas, respectively, terminate in the chamber 11. Slide seals 26 to 30 are in sliding contact with the two end surfaces 24 and 25 of the heat-exchanger 12 traversed by the fluid media parallel to the axis of rotation 14, which slide seals are so arranged in the circumferential direction relative to the axis of rotation 14 and are so formed that an area 31 in communication exclusively with the inlet pipe connection 16 and the housing channel 22 and an area 32 in communication exclusively with the outlet pipe connection 17 and the housing channel 23 result in the heat-exchanger 12. During the rotation of the heat-exchanger 12, the flow channels thereof pass sequentially through the areas 31 and 32, whereby these flow channels are traversed alternately by combustion air and exhaust gas.

The slide seals 26 to 30 are secured in each case at the one spring end 33 of coil springs 34 whose other spring end is soldered or brazed together with a plate 35. The plates 35 of the slide seals 26 to 28 cooperating with the end surface 24 of the heat-exchanger 12 are threadably connected to the adjacent chamber wall 36 of the turbine housing 10. In contradistinction thereto, the plates 35 of the slide seals 29 and 30 cooperating with the end surface 25 of the heat-exchanger 12 are threadably connected to the adjacent cover wall 37 of the housing cover 15.

The heat-exchanger 12 is rotatably supported on a hollow shaft 39 under interposition of a swash-plate bearing support generally designated by reference numeral 38 (FIG. 2) and is displaceably supported in the directions of the axis of rotation 14. The hollow shaft 39 is immovably supported in the directions perpendicular to the axis of rotation 14 within the bore 40 of a bearing eye or opening 41 of the cover wall 37. A threaded adaptor generally designated by reference numeral 42 is screwed with its threaded pin 43 fixedly into a threaded bore 44 of the chamber wall 36 concentric to the axis of rotation 14. The one end face of the hollow shaft 39 is supported against the end face or abutment surface 45 of the threaded adaptor 42 disposed in the plane 21—21. The other end face of the hollow shaft 39 abuts at a collar 46 of a bolt head 47 of an anchor bolt 48. The threaded end 49 of the anchor bolt 48 which extends through the hollow shaft 39 is screwed into a concentric, threaded through-bore 50 of the threaded adaptor 42. The collar 46 additionally abuts at a clamping surface 51 of the housing cover 15 in order to prevent a "breathing" of the cover.

In order that the cover wall 37 cannot be deformed by the clamping force of the anchoring bolt 48, the clamping surface 51 and the adjacent end face of the hollow shaft 39 must have the same distance to the chamber wall 36. For this reason, the end surface 45 serving as abutment for the hollow shaft 39 has to be machined accurately. This can take place simultaneously with the machining of the housing separating surface 19 since both of these surfaces lie in the same plane 21—21.

As can be seen from FIG. 3, the slide seals 26 to 28 secured at the chamber wall 36 have their own assembly position 52 recessed with respect to the housing separating surface 19 or the plane 21—21, when they are out of contact with the heat-exchanger 12 and when their coil springs 34 serving as mounting means are relieved or unstressed thereby. In this manner, the fragile heat-exchanger 12 sensitive to breakage as also the cover 15 can be installed and removed perpendicularly to the axis of rotation 14 if the anchor bolt 48 (FIG. 2) is screwed out of the threaded adaptor 42 and the heat-exchanger 12 is displaced on the hollow shaft 39 which continues to serve as seat of the heat-exchanger as a result of its bearing support within the bearing eye 41, so far that it is disposed outside of the turbine housing 10 limited by the plane 21—21. In order to further facilitate this disassembly, the heat-exchanger 12 is adapted to be anchored at the cover 15 in its own assembly position 53 (FIG. 3) recessed with respect to the cover separating surface 18. For this purpose, several tie rods 54 threadedly extending through the cover 15 are provided, at the ends of which located within the chamber 11 are secured abutment plates 55 which engage at the toothed rim 13 and retain the heat-exchanger 12 in the assembly position 53 under compression of the coil springs 34 cooperating with the slide seals 29 and 30. The bolt heads 56 of the tie rods 54 are located on the outside of the cover 15 and are therefore accessible only from the outside in order to be able to bring the heat-exchanger 12 into the assembly position 53 also with an assembled cover 15. In order to assure that a free residual spring path 57 (FIG. 3) is not dropped below for the coil springs 34 cooperating with the cover 15, when the heat-exchanger 12 is brought into its assembly position 53, the cover 15 is provided with abutments 58 at which the heat-exchanger 12 comes into abutment by means of a counter-abutment 59 of its toothed rim 13.

The end face of the hollow shaft 39 which abuts at the threaded adaptor 42 is located in the plane 21—21 so that the hollow shaft 39 can be immovably secured with respect to the cover 15 in the directions of the axis of rotation 14 without disturbing the assembly and disassembly of the heat-exchanger 12 perpendicular to the axis of rotation. The bore 40 can be constructed, for example, as press-fit. The fixing of the heat-exchanger 12 in the assembly position 53 is facilitated by the immovable fixing of the hollow shaft 39 at the cover 15 and a falling-out on the part of the hollow shaft 39 out of the bearing eye 41 is avoided thereby during the assembly and disassembly.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A gas turbine comprising a turbine housing means forming at least one regenerative chamber adapted to be closed off against the outside by a housing cover means, said regenerative chamber accommodating a regenerative heat-exchanger means adapted to be set into rotation relative to an axis of rotation, said turbine housing means having a housing separating surface means and said housing cover means having a cover separating surface means, said separating surface means being adapted to be brought into mutual abutment, at least one slide seal means adapted to be brought into sliding contact with the heat-exchanger means and arranged in the regenerative chamber, mounting means including two fastening members elastic relative to one another essentially in the directions of the axis of rotation, said slide seal means being secured at one of said two fastening members and the other fastening member being anchored at a chamber wall of the turbine housing means, characterized in that:

the housing separating surface means is located in a plane at least approximately perpendicular to the axis of rotation;

the slide seal means, with a relieved mounting means, is located in an assembly position of the heat-exchanger means recessed with respect to the housing separating surface means; and the heat-exchanger means is operable to be anchored at the cover means by tie rod means cooperating with additional means on the heat-exchanger means in the assembly position recessed relative to the cover separating surface means, said heat-exchanger means and said cover means being removable together as a structural unit from the turbine housing means.

2. A gas turbine according to claim 1, characterized in that said axis of rotation is fixed relative to the turbine housing means.

3. A gas turbine according to claim 1, characterized in that the mounting means include coil springs.

4. A gas turbine according to claim 1, in which at least one slide seal means adapted to be brought into sliding contact with the heat-exchanger means is secured at one of the two fastening members elastic relative to one another in the directions of the axis of rotation of a mounting means, whose other fastening member is anchored at the cover means, characterized in that, in the assembly position of the heat-exchanger means, the fastening member anchored at the cover means is springily movable relative to the other fastening member connected with the slide seal means.

5. A gas turbine according to claim 4, characterized in that the one fastening member is a plate member and in that the mounting means includes coil springs while the other fastening member is formed by the spring end of a respective coil spring.

6. A gas turbine according to claim 5, characterized in that a residual spring path is defined for the coil springs of the mounting means anchored at the cover means by a difference in the displacement between the heat-exchanger means and the cover means when the heat-exchanger means is in the assembly position from the displacement of the coil springs of the mounting means anchored at the cover means when the coil springs are in a fully compressed condition.

7. A gas turbine comprising a turbine housing means forming at least one regenerative chamber adapted to be closed off against the outside by a housing cover means, said regenerative chamber accommodating a regenerative heat-exchanger means adapted to be set into rotation relative to an axis of rotation, said turbine housing means having a housing separating surface means and said housing cover means having a cover separating surface means, said separating surface means being adapted to be brought into mutual abutment, at least one slide seal means adapted to be brought into sliding contact with the heat-exchanger means and arranged in the regenerative chamber, mounting means including two fastening members elastic relative to one another essentially in the directions of the axis of rotation, said slide seal means being secured at one of said two fastening members and the other fastening members being anchored at a chamber wall of the turbine housing means, characterized in that;

the housing separating surface means is located in a plane at least approximately perpendicular to the axis of rotation;

the slide seal means, with a relieved mounting means, is located in an assembly position of the heat-exchanger means recessed with respect to the housing separating surface means; and in which at least one slide seal means adapted to be brought into sliding contact with the heat-exchanger means is secured at one of the two fastening members elastic relative to one another in the directions of the axis of rotation of a mounting means, whose other fastening member is anchored at the cover means, characterized in that, in the assembly position of the heat-exchanger means, the fastening member anchored at the cover means is springily movable relative to the other fastening member connected with the slide seal means, characterized in that at least one tie rod means cooperating with the heat-exchanger means and accessible from the outside extends through the cover means for purposes of achoring the heat exchanger means in the assembly position.

8. A gas turbine according to claim 7, characterized in that the cover means includes for the assembly position at least one abutment cooperating with a corresponding counter-abutment of the heat-exchanger means.

9. A gas turbine according to claim 8, characterized in that the heat-exchanger means is supported on a hollow shaft concentric to the axis of rotation, which is immovably inserted in the directions perpendicular to the axis of rotation into a bearing opening extending through the cover means.

10. A gas turbine according to claim 9, characterized in that an anchor bolt extends through the hollow shaft, said hollow shaft being clamped at a chamber wall of the turbine housing means by means of the anchor bolt located with its bolt head outside of the chamber.

11. A gas turbine according to claim 10, characterized in that the anchor bolt is detachably screwed into a threaded adaptor means detachably secured at the chamber wall and the hollow shaft is clamped in between the adaptor means and the bolt head of the anchor bolt.

12. A gas turbine according to claim 11, characterized in that the adaptor means includes an abutment surface for the hollow shaft, said abutment surface being located at least approximately in the same plane with the housing separating surface means.

13. A gas turbine according to claim 12, characterized in that the heat-exchanger means is operable to be anchored at the cover means in an assembly position recessed relative to the cover separating surface means.

14. A gas turbine according to claim 1, characterized in that at least one tie rod means cooperating with the additional means on the heat-exchanger means and accessible from the outside extends through the cover means.

15. A gas turbine comprising at least one regenerative chamber adapted to be closed off against the outside by a housing cover means, said regenerative chamber accommodating a regenerative heat-exchanger means adapted to be set into rotation relative to an axis of rotation, said turbine housing means having a housing separating surface means and said housing cover means having a cover separating surface means, said separating surface means being adapted to be brought into mutual abutment, at least one slide seal means adapted to be brought into sliding contact with the heat-exchanger means and arranged in the regenerative chamber, mounting means including two fastening members elastic relative to one another essentially in the directions of the axis of rotation, said slide seal means being secured at one of said two fastening members and the other fastening member being anchored at a chamber wall of the turbine housing means, characterized in that:

the housing separating surface means is located in a plane at least approximately perpendicular to the axis of rotation;

the slide seal means, with a relieved mounting means, is located in an assembly position of the heat-exchanger means recessed with respect to the housing separating surface means; and characterized in that the cover means includes for the assembly position at least one abutment cooperating with a corresponding counter-abutment of the heat-exchanger means for purposes of anchoring the heat exchanger means in the assembly position.

16. A gas trubine according to claim 1, characterized in that the heat-exchanger means is supported on a hollow shaft concentric to the axis of rotation, which is immovably inserted in the directions perpendicular to the axis of rotation into a bearing opening extending through the cover means.

17. A gas turbine comprising a turbine housing means forming at least one regenerative chamber adapted to be closed off against the outside by a housing cover means, said regenerative chamber accommodating a regenerative heat-exchanger means adapted to be set into rotation relative to an axis of rotation, said turbine housing means having a housing separating surface means and said housing cover means having a cover separating surface means, said separating surface means being adapted to be brought into mutual abutment, at least one slide seal means adapted to be brought into sliding contact with the heat-exchanger means and arranged in the regenerative chamber, mounting means including two fastening members elastic relative to one another essentially in the directions of the axis of rotation, said slide seal means being secured at one of said two fastening members and the other fastening member being anchored at a chamber wall of the turbine housing means, characterized in that:

the housing separating surface means is located in a plane at least approximately perpendicular to the axis of rotation;

the slide seal means, with a relieved mounting means, is located in an assembly position of the heat-exchanger means recessed with respect to the housing separating surface means;

characterized in that the heat-exchanger means is supported on a hollow shaft concentric to the axis of rotation, which is immovably inserted in the directions perpendicular to the axis of rotation into a bearing opening extending through the cover means;

characterized in that an anchor bolt extends through the hollow shaft, said hollow shaft being clamped at a chamber wall of the turbine housing means by means of the anchor bolt located with its bolt head outside of the chamber.

18. A gas turbine according to claim 17, characterized in that the anchor bolt is detachably screwed into a threaded adaptor means detachably secured at the chamber wall and the hollow shaft is clamped in between the adaptor means and the bolt head of the anchor bolt.

19. A gas turbine according to claim 18, characterized in that the adapter means includes an abutment surface for the hollow shaft, said abutment surface being located at least approximately in the same plane with the housing separating surface means.

* * * * *